US009082379B2

(12) United States Patent
Bottrell, Jr.

(10) Patent No.: US 9,082,379 B2
(45) Date of Patent: Jul. 14, 2015

(54) METHOD AND APPARATUS OF A MODULAR GUITAR STRAP

(71) Applicant: CDB Straps, LLC, Scottsdale, AZ (US)

(72) Inventor: Cletus D. Bottrell, Jr., Scottsdale, AZ (US)

(73) Assignee: CDB Straps, LLC, Scottsdale, AZ (US)

( * ) Notice: Subject to any disclaimer, the term of this patent is extended or adjusted under 35 U.S.C. 154(b) by 0 days.

(21) Appl. No.: 14/184,637

(22) Filed: Feb. 19, 2014

(65) Prior Publication Data

US 2014/0251113 A1 Sep. 11, 2014

Related U.S. Application Data

(60) Provisional application No. 61/773,165, filed on Mar. 6, 2013, provisional application No. 61/831,146, filed on Jun. 5, 2013.

(51) Int. Cl.
*G10G 5/00* (2006.01)

(52) U.S. Cl.
CPC ..... *G10G 5/005* (2013.01); *Y10T 29/49826* (2015.01)

(58) Field of Classification Search
CPC . Y10S 224/91; Y10S 224/93; Y10S 224/913; G10G 5/005; G10G 5/00; G10G 7/005; A45F 5/00; A45F 3/14; A45F 2005/006; A45F 2003/002; A45F 3/02; A45F 3/04; A45F 2003/025; A45F 2003/045; A45F 2005/008; A45F 2003/14
USPC ..... 84/327, 329; 224/910, 242, 254–255, 224/264–265, 272
See application file for complete search history.

(56) References Cited

U.S. PATENT DOCUMENTS

| | | | | |
|---|---|---|---|---|
| 4,188,851 | A | 2/1980 | Wolf | |
| 4,274,181 | A | 6/1981 | Schaller | |
| 4,291,822 | A * | 9/1981 | Simonds | 224/257 |
| 4,613,067 | A * | 9/1986 | Gann | 224/150 |
| 6,269,991 | B1 | 8/2001 | Hood et al. | |
| 6,359,203 | B1 * | 3/2002 | Cronos | 84/327 |
| 7,062,794 | B2 * | 6/2006 | LeBlanc | 2/312 |
| 7,358,430 | B2 | 4/2008 | Tambara | |
| 7,491,876 | B2 | 2/2009 | Peacock | |
| 8,101,840 | B1 | 1/2012 | Boulanger | |
| 2012/0031252 | A1 * | 2/2012 | Boulanger | 84/327 |

* cited by examiner

*Primary Examiner* — Kimberly Lockett
(74) *Attorney, Agent, or Firm* — Morrison & Foerster LLP

(57) ABSTRACT

Examples of the disclosure are directed toward a modular guitar strap, wherein one or more modular guitar strap ends may be detachable from the guitar strap for replacement. A guitar strap end may be made from an exotic material, such as snakeskin, and bonded to a durable material, such as nylon fabric, so that the guitar strap end can hold up to wear and tear even while its outer appearance is that of an exotic material.

8 Claims, 8 Drawing Sheets

METHOD AND APPARATUS OF A MODULAR GUITAR STRAP

FIELD OF THE DISCLOSURE

This relates generally to straps, such as a guitar strap or a bag strap.

BACKGROUND OF THE DISCLOSURE

A guitar strap may be a strip of fabric or other material that attaches to a guitar at each end of the strap, allowing the guitar to be strapped to a player over a shoulder like a sling. The ends of a guitar strap may be integral to the strap and may not be easily removed or replaced. Further, the material of the strap ends must be strong enough to withstand wear and tear, and thus exotic materials such as snakeskin generally may not be used for guitar strap ends.

SUMMARY

Examples of the disclosure are directed toward a modular guitar strap, wherein one or more modular guitar strap ends may be detachable from the guitar strap for replacement. A guitar strap end may be made from an exotic material, such as snakeskin, and bonded to a durable material, such as nylon fabric, so that the guitar strap end can hold up to wear and tear even while its outer appearance is that of an exotic material.

In some examples, the guitar strap may be detachable from a strap adjuster, allowing the strap to be reattached in a different orientation, which may be aesthetically pleasing where a design on the strap looks differently in different orientations. This feature may also be useful for left-handed guitar players. If an image on a strap is printed with right-handed guitar players in mind, the image may appear upside down when the strap is worn by a left-handed guitar player. If the strap can be disconnected from the strap adjuster and reconnected in a different orientation, then such a strap may be used by a left-handed player with the image in the desired orientation.

DETAILED DESCRIPTION

In the following description of embodiments, reference is made to the accompanying drawings which form a part hereof, and in which it is shown by way of illustration specific embodiments which can be practiced. It is to be understood that other embodiments can be used and structural changes can be made without departing from the scope of the disclosed embodiments.

A guitar strap may be a strip of fabric or other material that attaches to a guitar at each end of the strap, allowing the guitar to be strapped to a player over a shoulder like a sling. The ends of a guitar strap may be integral to the strap and may not be easily removed or replaced. Further, the material of the strap ends must be strong enough to withstand wear and tear, and thus exotic materials such as snakeskin generally may not be used for guitar strap ends.

Examples of the disclosure are directed toward a modular guitar strap, wherein one or more modular guitar strap ends may be detachable from the guitar strap for replacement. A guitar strap end may be made from an exotic material, such as snakeskin, and bonded to a durable material, such as nylon fabric, so that the guitar strap end can hold up to wear and tear even while its outer appearance is that of an exotic material.

In some examples, the guitar strap may be detachable from a strap adjuster, allowing the strap to be reattached in a different orientation, which may be aesthetically pleasing where a design on the strap looks differently in different orientations. This feature may also be useful for left-handed guitar players. If an image on a strap is printed with right-handed guitar players in mind, the image may appear upside down when the strap is worn by a left-handed guitar player. If the strap can be disconnected from the strap adjuster and reconnected in a different orientation, then such a strap may be used by a left-handed player with the image in the desired orientation.

Although examples of the disclosure may be discussed with reference to guitar straps, the methods and apparatuses disclosed are not so limited and may also be applied to straps in general, such as straps for bags and cases.

Figure 1:
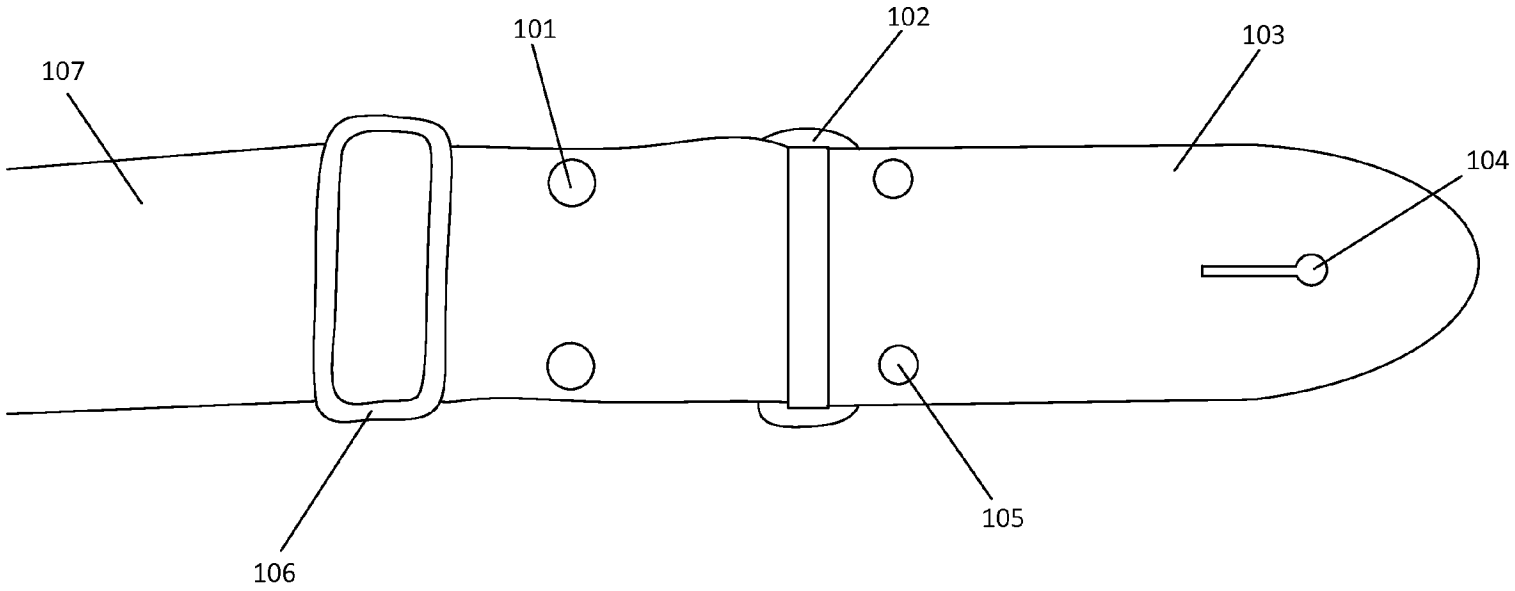
FIG. 1 illustrates a top view of a first end of an exemplary modular guitar strap according to examples of the disclosure.

FIG. 1 illustrates a top view of a first end of an exemplary modular guitar strap according to examples of the disclosure. The modular guitar strap may include a fabric strip 107. For example, the fabric strip may be made of nylon fabric, among other possibilities. The length of the fabric strip 107 may be adjustable by use of a coupled strap adjustor 106, as is well known in the art. A strap end 103 may be coupled to the fabric strip 107 so that the strap may be attached to a guitar. The strap end 103 may include a mounting hole 104, capable of fitting around a strap button on a guitar. The strap end 103 may further include a loop 102 coupled to the strap end. The first end of the strap may be threaded through the loop 102 and fastened back to itself by one or more screw posts 101. The screw posts 101 may be unscrewed by a user, allowing the user to detach the strap end 103 from the guitar strap and reattach the same or different strap end as desired. The strap end 103 may further include one or more rivets 105 for ornamental purposes and/or to attach the loop 102 to the strap end. Although the figures and examples are described with respect to screw posts, any detachable fasteners may be used, such as brads or buttons, among other possibilities. Further, although the figures and examples are described with respect to rivets, other bindings may be used, such as grommets or screw posts, among other possibilities.

Figure 2:
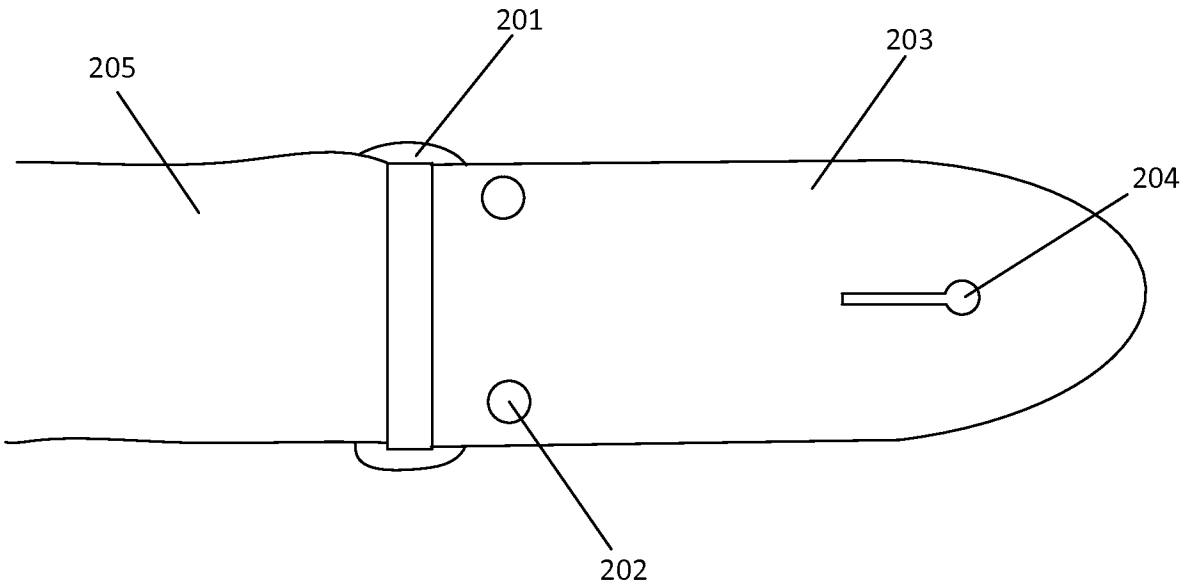
FIG. 2 illustrates a top view of a second end of an exemplary modular guitar strap according to examples of the disclosure.

FIG. 2 illustrates a top view of a second end of an exemplary modular guitar strap according to examples of the disclosure. The modular guitar strap may include a fabric strip 205 coupled to a second strap end 203 with a loop 201. The second strap end may include a mounting hole 204 and one or more rivets 202, and in some examples the second strap end may be made of leather or imitation leather, among other possibilities. Although FIGS. 1 and 2 illustrate a first end of a guitar strap having a detachable strap end (FIG. 1) and a second end of the guitar strap having a non-detachable strap end (FIG. 2), examples are not so limited, and both ends may be detachable according to examples of the disclosure.

Figure 3:
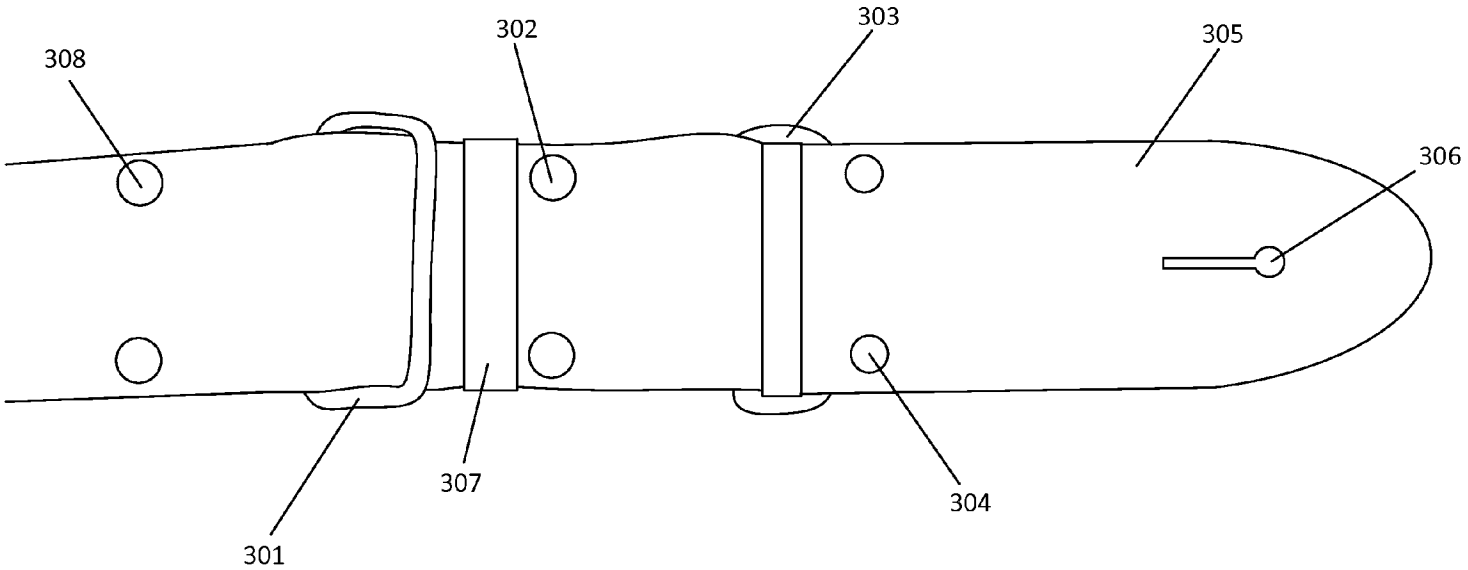
FIG. 3 illustrates a bottom view of a first end of an exemplary modular guitar strap according to examples of the disclosure.

FIG. 3 illustrates a bottom view of a first end of an exemplary modular guitar strap according to examples of the disclosure. Similarly to FIG. 1, the bottom view illustrated in FIG. 3 includes a fabric strip having screw posts 302 and a strap adjuster 301 and, further, a strap end 305 having a mounting hole 306, rivets 304, and a loop 303. The bottom view additionally illustrates a leather cap 307 to cover the end of the fabric strip that is secured by the screw posts 302. The leather cap 307 may cover the end of the fabric strip both for aesthetic reasons and to protect the end from fraying, tearing, and/or other damage. Although the cap is described as leather, in some examples it may be made of plastic, among other possibilities. In some examples, a portion of the fabric strip may be threaded through a loop on the strap adjuster 301 and fastened back to itself by one or more screw posts 308, coupling the fabric strip to the strap adjuster in a detachable fashion.

Figure 4:
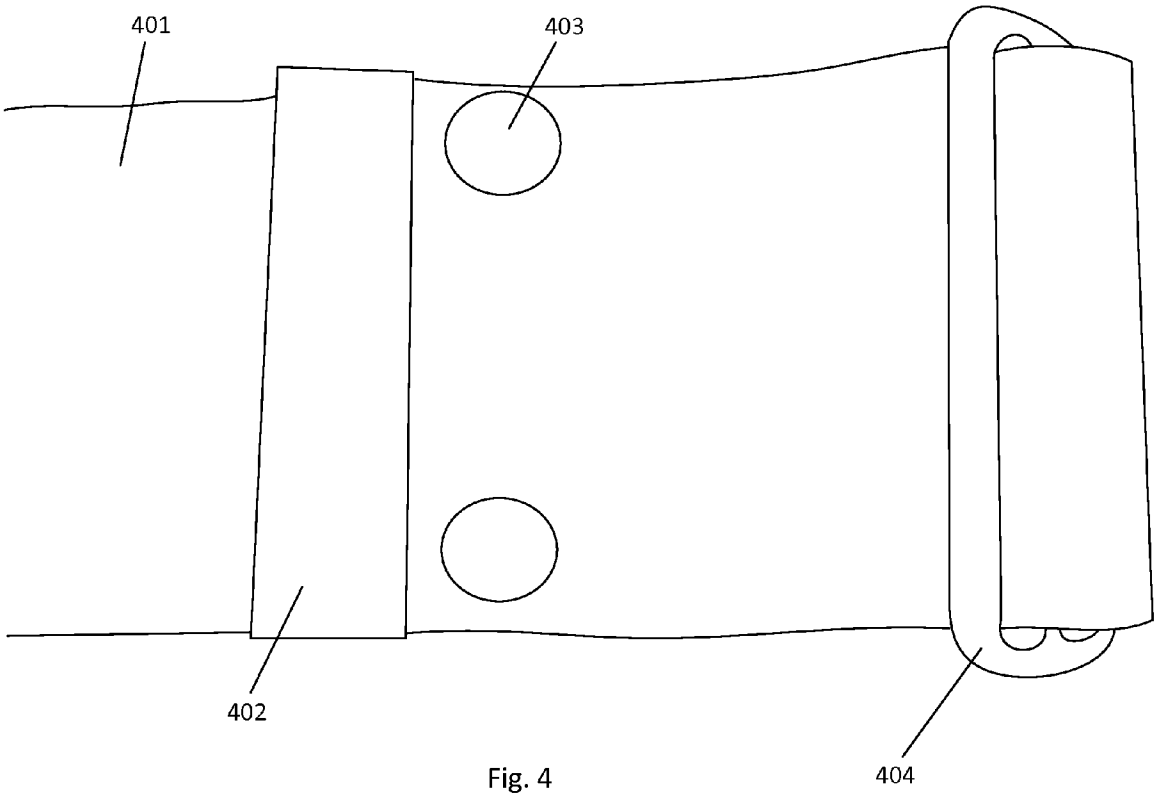
FIG. 4 illustrates a bottom view of a first end of an exemplary modular guitar strap according to examples of the disclosure.

FIG. 4 illustrates a bottom view of a first end of an exemplary modular guitar strap according to examples of the disclosure. Similarly to FIG. 3, FIG. 4 illustrates a fabric strip 401 threaded through a strap adjuster 404 and fastened back to itself by screw posts 403. Further, FIG. 4 illustrates a leather cap 402, which may cover the end of the fabric strip that is threaded through the strap adjuster 404 and secured by the screw posts 403.

Figure 5:
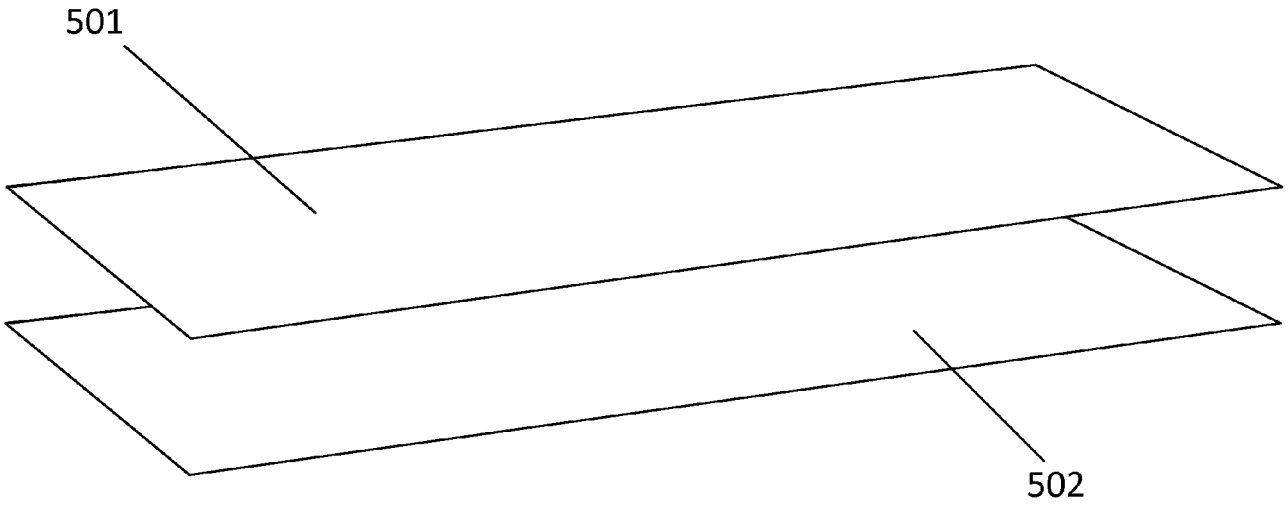
FIG. 5 illustrates an exemplary bonding of two materials for a modular guitar strap end according to examples of the disclosure.

FIG. 5 illustrates an exemplary bonding of two materials for a modular guitar strap end according to examples of the disclosure. The first material 501 may be a durable material such as nylon fabric, among other possibilities. The second material 502 may be an exotic material such as snakeskin, among other possibilities. The two materials may be bonded using an adhesive.

Figure 6:
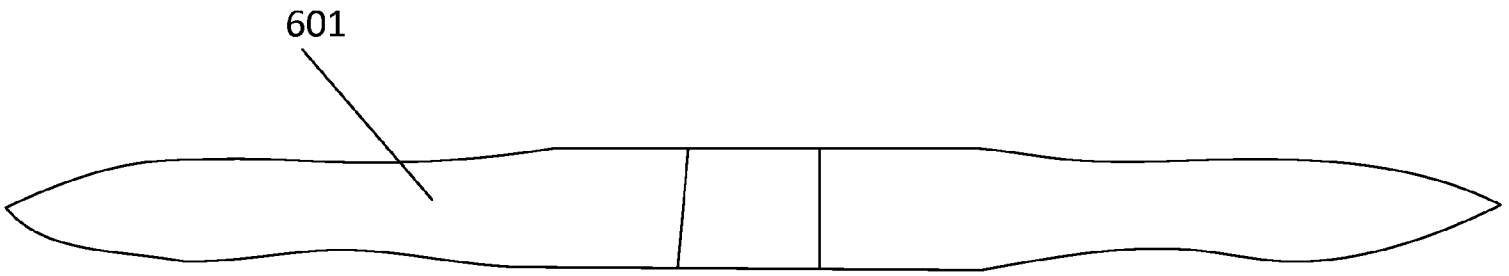
FIG. 6 illustrates an exemplary cut and bonded modular guitar strap end according to examples of the disclosure.

FIG. 6 illustrates an exemplary cut and bonded modular guitar strap end according to examples of the disclosure. After bonding the two materials, the guitar strap end 601 may be cut into a desired shape.

Figure 7:
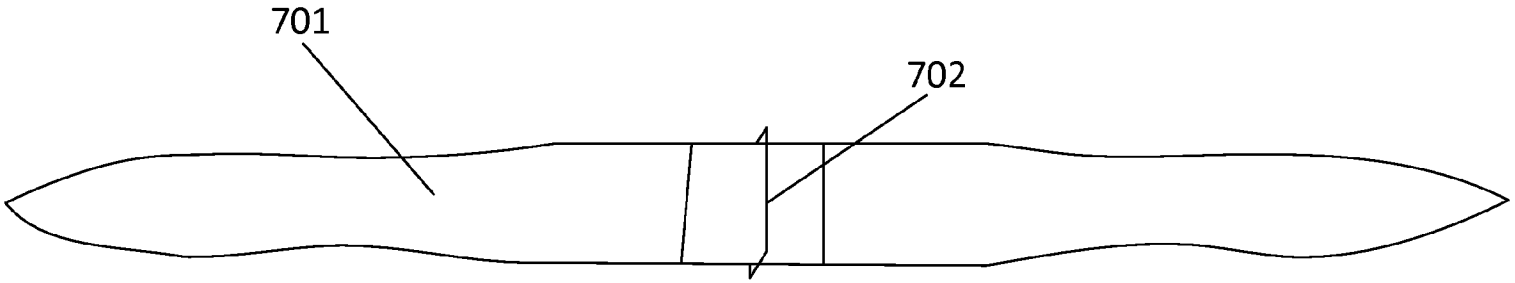
FIG. 7 illustrates an exemplary cut and bonded modular guitar strap end with a metal loop according to examples of the disclosure.

FIG. 7 illustrates an exemplary cut and bonded modular guitar strap end with a metal loop according to examples of the disclosure. After the bonded materials have been cut into a desired shape, the guitar strap end 701 may be threaded through a loop 702.

Figure 8:
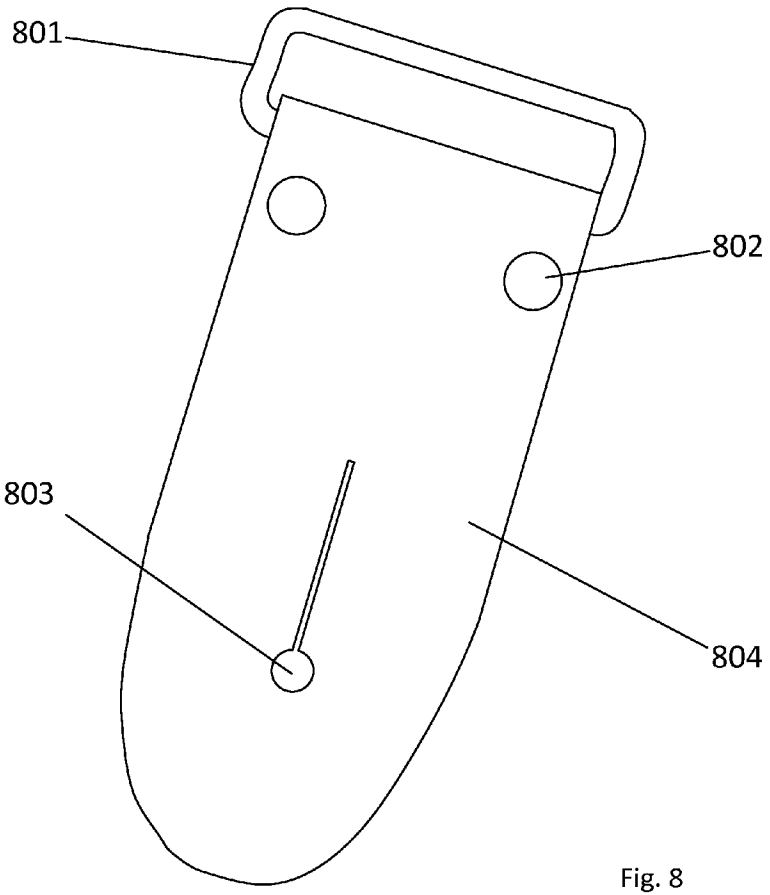
FIG. 8 illustrates an exemplary modular guitar strap end according to examples of the disclosure.

FIG. 8 illustrates an exemplary modular guitar strap end according to examples of the disclosure. After threading the strap end 804 through the loop 801, the two ends of the strap end may be attached together. In some examples, adhesive may be used to attach the two ends together, among other possibilities. Further, a mounting hole 803 may be cut in the guitar strap end 804 and one or more rivets 802 may be added.

Although the disclosed embodiments have been fully described with reference to the accompanying drawings, it is to be noted that various changes and modifications will become apparent to those skilled in the art. Such changes and modifications are to be understood as being included within the scope of the disclosed embodiments as defined by the appended claims.

What is claimed is:

1. A modular guitar strap comprising:

a strip having a first end, a second end, and a slide adjuster capable of adjusting the length of the strip;

one or more screw posts coupled to the strip at the slide adjuster, wherein the one or more screw posts may be unscrewed such that the slide adjuster may be decoupled from the strip;

a loop coupled to the strip at the first end of the strip; and a strap end coupled to the loop, the strap end including a mounting hole capable of coupling the strap end to a guitar;

wherein the first end of the strip is threaded through the loop and is fastened back to the strip by the one or more screw posts so as to couple the loop to the strip;

wherein the one or more screw posts may be unscrewed such that the loop and the strap end may be decoupled from the strip.

2. The modular guitar strap of claim 1, wherein the strap end further includes one or more rivets.

3. The modular guitar strap of claim 1, wherein the strap end comprises a nylon base layer bonded to a second material.

4. The modular guitar strap of claim 3, wherein the second material is snakeskin.

5. A method of replacing a strap end of a modular guitar strap, the method comprising:

unfastening one or more screw posts of the modular guitar strap, so as to decouple a first strap end from the modular guitar strap;

removing the modular guitar strap from a loop of the first strap end;

threading a portion of the modular guitar strap through a loop of a second strap end;

fastening the one or more screw posts of the modular guitar strap, so as to couple the second strap end to the modular guitar strap;

after removing the modular guitar strap from the loop of the first strap end, removing a portion of the modular guitar strap from a slide adjuster;

removing the modular guitar strap from a loop of a third strap end;

threading a portion of the modular guitar strap through a loop of a fourth strap end; and threading a portion of the modular guitar strap through the slide adjuster;

wherein a portion of the modular guitar strap is threaded through the loop of the second strap end after a portion of the modular guitar strap is threaded through the slide adjuster.

6. A modular guitar strap comprising:

a strip having a first end, a second end, and a slide adjuster capable of adjusting the length of the strip;

one or more screw posts coupled to the strip at the first end of the strip;

a loop coupled to the strip at the first end of the strip, wherein the first end of the strip is threaded through the loop and is fastened back to the strip by the one or more screw posts so as to couple the loop to the strip; and a strap end coupled to the loop, the strap end including one or more rivets and a mounting hole capable of coupling the strap end to a guitar;

wherein the one or more screw posts may be unscrewed such that the loop and the strap end may be decoupled from the strip.

7. The modular guitar strap of claim 6, wherein the strap end comprises a nylon base layer bonded to a second material.

8. The modular guitar strap of claim 6, wherein the second material is snakeskin.

* * * * *